US006595135B2

(12) United States Patent
Dowling et al.

(10) Patent No.: US 6,595,135 B2
(45) Date of Patent: Jul. 22, 2003

(54) PRINTING UNIT WITH AUTOMATICALLY MOVEABLE TAIL TUCKER BAR

(75) Inventors: John Joseph Dowling, Rollinsford, NH (US); Daniel Paul Gagne, South Berwick, ME (US); Brian Joseph Gentle, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/850,205

(22) Filed: May 7, 2001

(65) Prior Publication Data

US 2002/0162468 A1 Nov. 7, 2002

(51) Int. Cl.[7] ..... B41F 27/12
(52) U.S. Cl. ..... 101/477; 101/415.1
(58) Field of Search ..... 101/415.1, 477, 101/382.1, 383

(56) References Cited

U.S. PATENT DOCUMENTS 5,074,212 A * 12/1991 Kobler et al. ..... 101/415.1
5,224,423 A 7/1993 Borel ..... 101/415
5,435,242 A * 7/1995 Kusch et al. ..... 101/142
5,483,892 A * 1/1996 Stiel ..... 101/415.1
5,555,810 A * 9/1996 Stiel ..... 101/415.1
5,619,926 A * 4/1997 Engelmann et al. ..... 101/415.1
5,678,487 A * 10/1997 Guaraldi et al. ..... 101/415.1
5,701,822 A * 12/1997 Metrope ..... 101/477
5,868,072 A * 2/1999 Nishi ..... 101/415.1
6,026,745 A * 2/2000 Hirokawa et al. ..... 101/415.1
6,334,393 B1 * 1/2002 Asai et al. ..... 101/415.1
6,439,117 B1 8/2002 Dumais et al. ..... 101/383
6,460,457 B1 * 10/2002 Ramsay ..... 101/477

FOREIGN PATENT DOCUMENTS

EP 0455068 11/1991
EP 1155837 11/2001

* cited by examiner

*Primary Examiner*—Andrew H. Hirshfeld
*Assistant Examiner*—Dave A. Ghatt
(74) *Attorney, Agent, or Firm*—Davidson, Davidson & Kappel, LLC

(57) ABSTRACT

A printing unit having a tucker bar capable of tucking a tail edge of a printing plate into an axially-extending gap of a plate cylinder and a tucker bar control device for automatically moving the tucker bar from an operating position to a non-operating position so as to permit access to the axially-extending gap. In addition, a method of plating a plate cylinder using such a tucker bar control device to automatically move the tucker bar so as to permit access to the axially-extending gap of the plate cylinder.

7 Claims, 5 Drawing Sheets

PRINTING UNIT WITH AUTOMATICALLY MOVEABLE TAIL TUCKER BAR

BACKGROUND OF THE INVENTION

1. Field of the Invention

The present invention relates generally to printing presses and more particularly to a printing unit including control device for automatically moving a tucker bar away from its operating position and a method for plating a plate cylinder using such a control device.

2. Background Information

Offset lithographic printing presses, for example, have a plate cylinder and a blanket cylinder for transferring images from a printing cylinder to a web of material, such as paper.

A flat printing plate typically is attached to the plate cylinder via an axially-extending gap. The lead edge of the plate is inserted in the gap, and the plate cylinder is rotated, so that a plate-to-blanket nip forces the plate to wrap around the plate cylinder. A tucker bar than is used to tuck the tail edge of the plate into the axially-extending gap.

U.S. Pat. No. 6,439,117, for example, which is hereby incorporated by reference herein (and is which is not necessarily prior art to the present invention), discloses a tucker bar.

In order to provide access to the plate cylinder for inserting the lead edge, tucker bars typically have been moved manually away from the plate cylinder into a non-operating position where they cannot tuck the tail edge. This can be a time-consuming operation.

BRIEF SUMMARY OF THE INVENTION

An object of the present invention is to provide a device and method for automatically moving a tucker bar to aid in plating a printing press.

The present invention provides a printing unit with a plate cylinder having an axially-extending gap. A tucker bar has an operating position, the tucker bar in the operating position capable of tucking a tail end of a printing plate into the axially-extending gap. A tucker bar control device automatically moves the tucker bar away from the operating position to a non-operating position.

The printing unit may further include a frame supporting the plate cylinder and tucker bar with the tucker bar control device being attached to the frame. The tucker bar control device may include an eccentric cam, which may be rotated, for example, using a pneumatic motor.

During the plating process, it may be necessary to run the press in the forward and reverse directions to adjust the position of the axially-extending gap on the plate cylinder. Preferably, the tucker bar in the operating position is located at a nip between the plate cylinder and a blanket cylinder to guard the nip and to provide improved safety when the web is rolling in the forward direction. Also, the tucker bar can advantageously be moved to non-operating position located at a nip between two blanket cylinders to guard the nip and to provide improved safety when the web is rolling in the reverse direction.

The tucker bar control device may also include a lever operationally connected to the tucker bar and the tucker bar control device to enable manually moving the tucker bar from an operating to a non-operating position for cleaning and maintenance.

The invention further provides a method for plating a plate cylinder. A tucker bar control device is used to automatically move a tucker bar from an operating position to a non-operating position so as to permit access to an axially-extending gap in the plate cylinder. A lead end of a printing plate is inserted into the axially-extending gap.

The method may include moving the tucker bar from a position in which it guards a nip between the plate cylinder and an adjacent blanket cylinder in the operating position. Also, the method may include moving the tucker bar to a position in which it guards a nip between the adjacent blanket cylinder and a second blanket cylinder in the non-operating position.

The control device aids in permitting an operator to access the plate cylinder for improved plating without having to manually move the tucker bar, resulting in a significant saving of time and effort.

BRIEF DESCRIPTION OF THE DRAWINGS

Similar elements are numbered similarly in the Figures.

DETAILED DESCRIPTION

Figure 1:
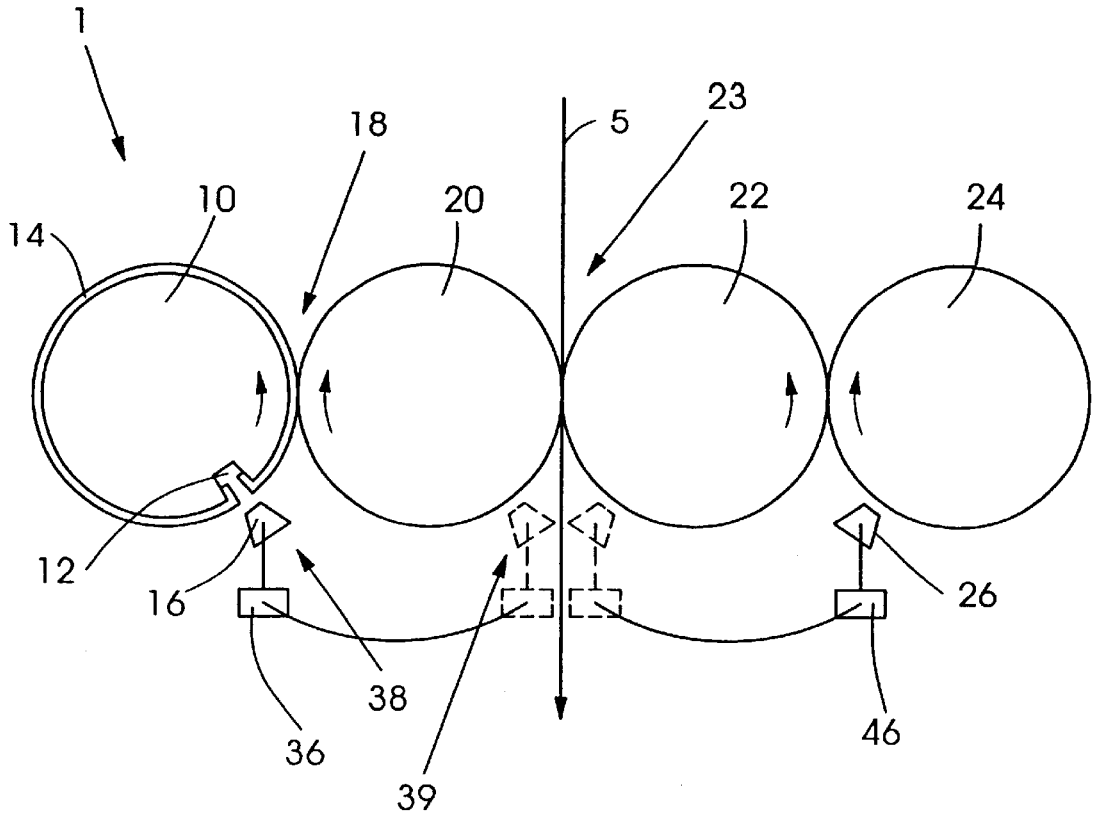
FIG. 1 shows a schematic cross-section of a preferred embodiment of the printing press of the present invention.

FIG. 1 shows a schematic cross-section of a preferred embodiment of the printing press 1 of the present invention. Printing press 1 includes a plate cylinder 10 having an axially-extending gap 12. A flat printing plate 14 has a lead edge which can be fit into the axially-extending gap 12. A tucker bar 16 can tuck the tail edge of the printing plate 14 into the gap, after which the plate can be locked-up to be held in place.

The plate cylinder 10 interacts with a blanket cylinder 20, on which may be held a flat or tubular-shaped blanket, so as to form a plate-to blanket nip 18. A web 5 can pass between the blanket cylinder 20 and another blanket cylinder 22, which thus forms a blanket-to-blanket nip 23. A second plate cylinder 24 with a second tucker bar 26 can interact with the blanket cylinder 22.

Tucker bar 16 has a tucker bar control device 36 for moving the tucker bar 16 from an operating position indicated by arrow 38—in which the tucker bar can tuck the tail edge of the plate into an axially-extending gap of the plate cylinder—and a non-operating position indicated by arrow 39. In the operating position tuckers in the tucker bar 16 can be actuated to selectively contact the tail edge of the late, as described, for example, in U.S. Pat. No. 6,439,117.

Preferably, the tucker bar control device 36 can move the tucker bar 16 from a position next to the plate-to-blanket nip 18, to the blanket-to-blanket nip 23. Control device 36 may be a motor-driven four-bar mechanism or other appropriate linkage for moving the tucker bar 16 along an arc similar to the outer surface of blanket cylinder 20. Alternatively, control device 36 may be a motor-driven carriage located on a curved track with an arc similar to the outer surface of blanket cylinder 20, the tucker bar 16 being fixedly connected to the carriage 36.

Tucker bar 26 has a control device 46 operating in a similar fashion to control device 36.

Figure 2:
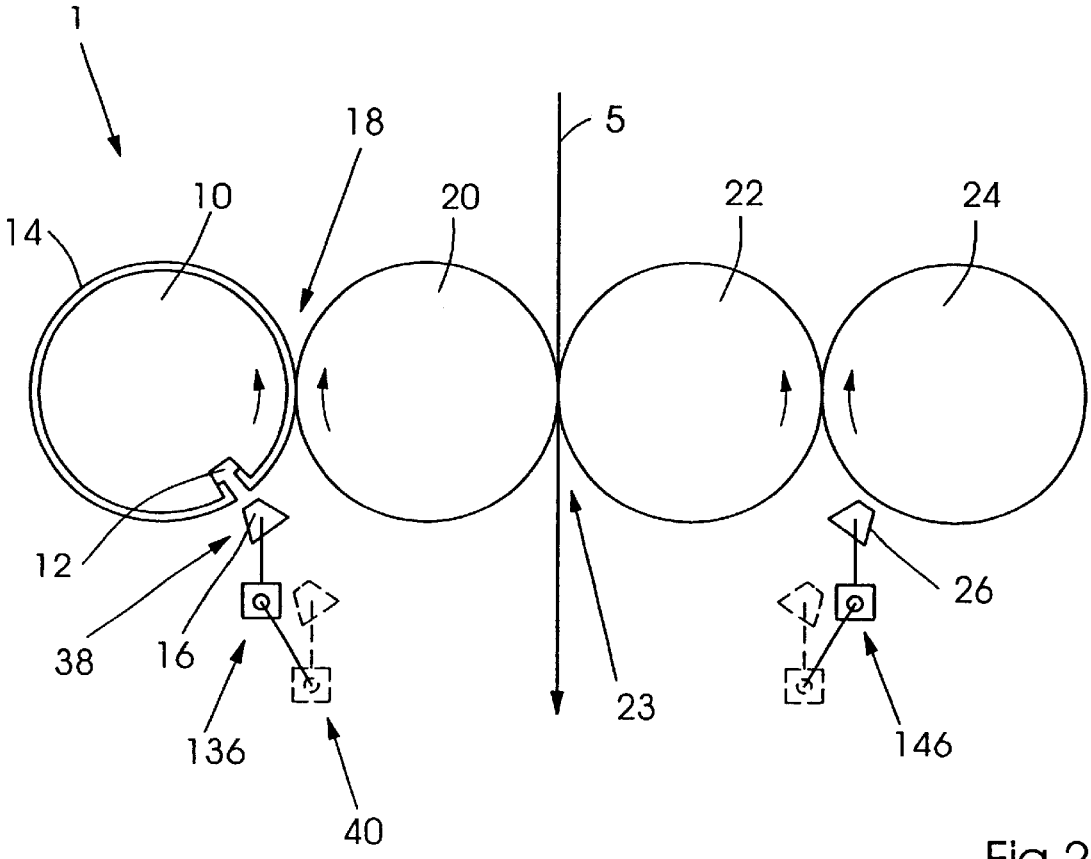
FIG. 2 shows a schematic cross-section of an alternate embodiment of the printing press of the present invention.

FIG. 2 shows an alternate embodiment of the control device 136 for moving the tucker bar 26 from an operating position 38 to a second non-operating position 40 away from the plate cylinder.

Figure 3:
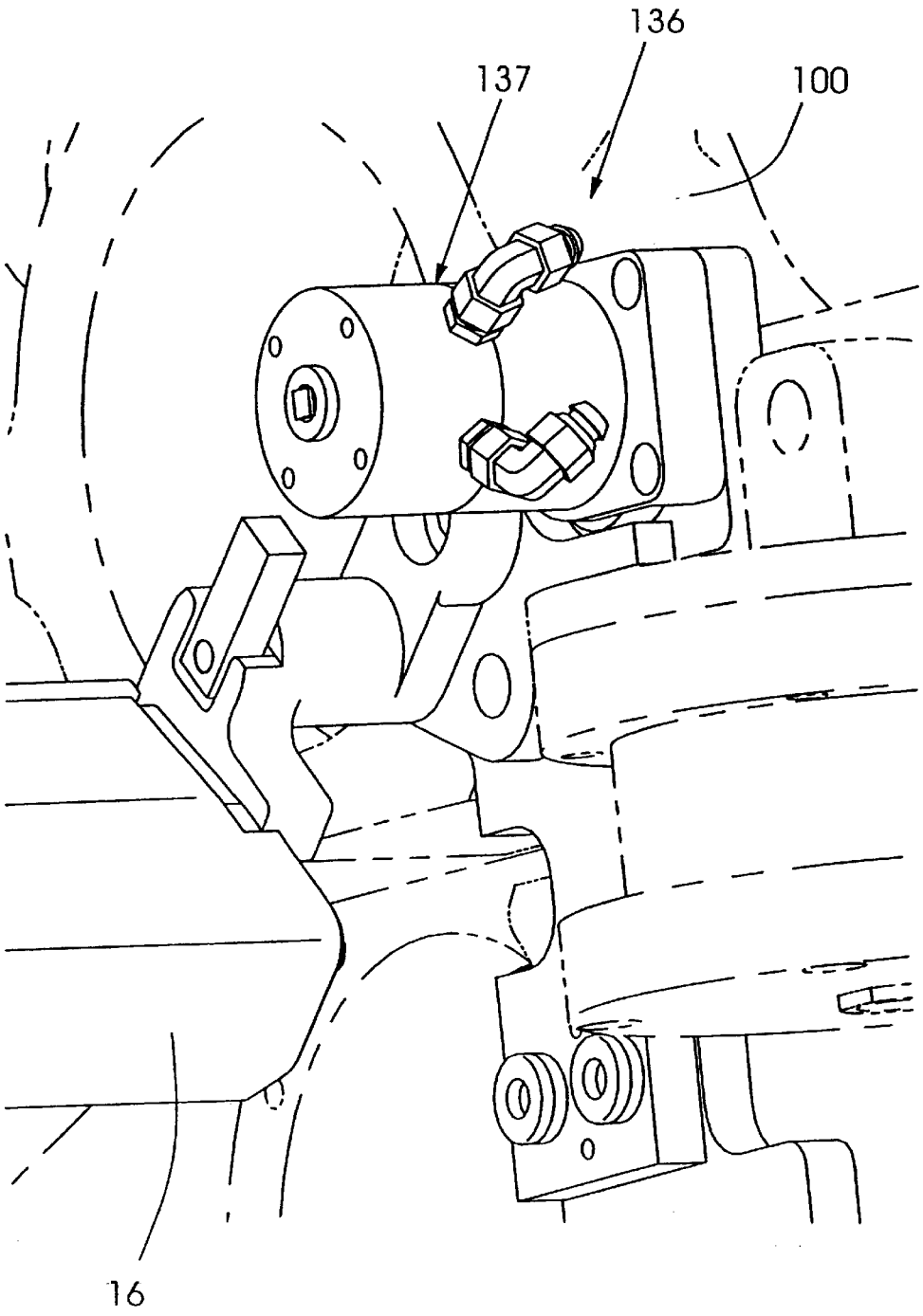
FIG. 3 shows a schematic view of an exemplary tucker bar control device, in which the tucker bar is shown in an operating position.

FIG. 3 shows a view of the control device 136 mounted on frame 100 and tucker bar 16 in which the tucker bar 16 is shown in the operating position. A pneumatically-driven motor in the form of a 180-degree rotary pneumatic cylinder 137 is used to drive an eccentric disk which is not visible in FIG. 3. The rotary pneumatic cylinder 137 can be actuated by the press operator.

Figure 4:
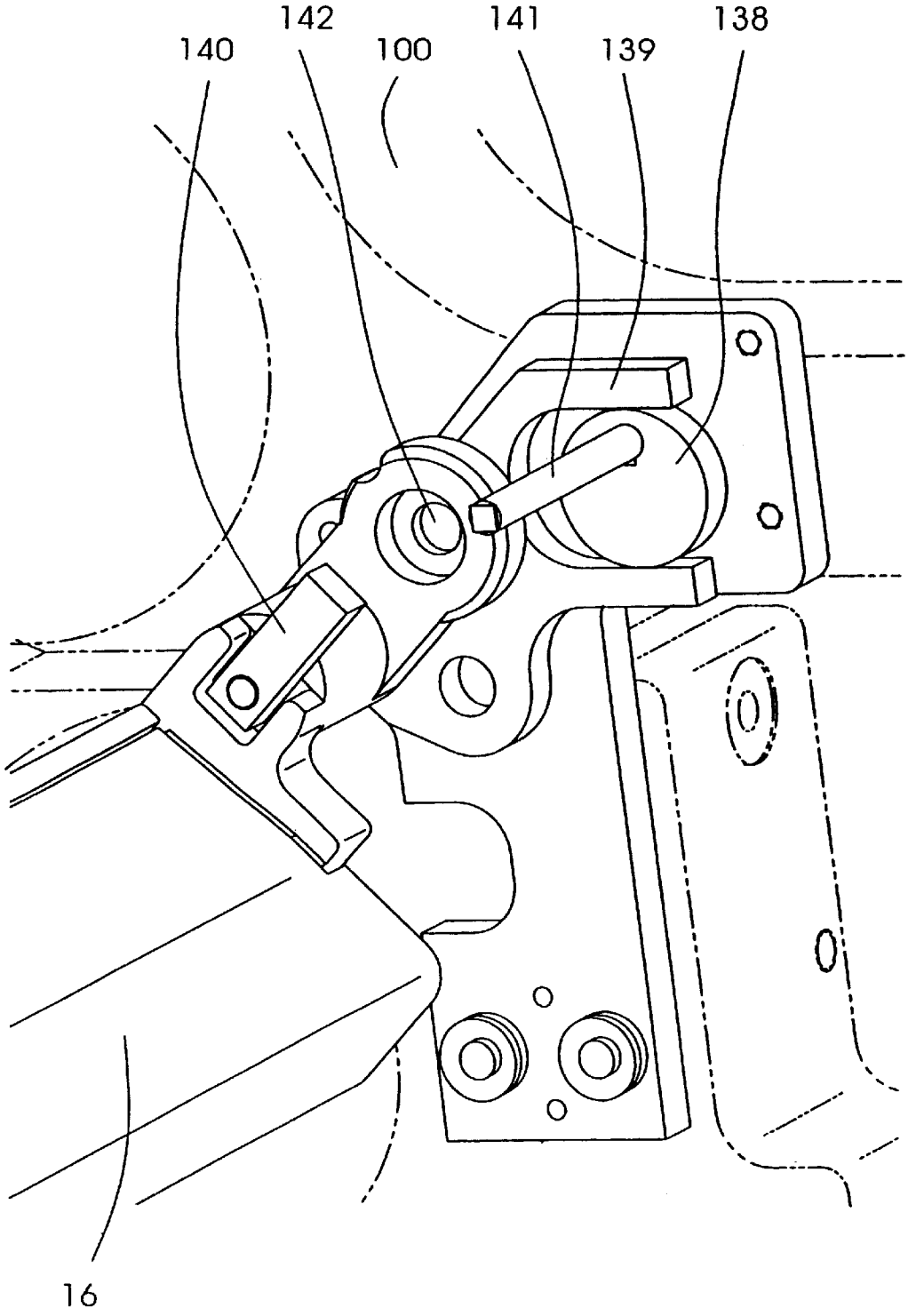
FIG. 4 shows a schematic view of a portion of the exemplary tucker bar control device shown in FIG. 3, in which the rotary pneumatic cylinder has been removed to show an eccentric cam.

FIG. 4 shows a view of a portion of the control device 136 of FIG. 3 with the rotary pneumatic cylinder removed to show an eccentric disk 138 which can rotate relative to frame 100 about a pivot axis 141 that is fixed to frame 100. Eccentric disk 138 can rotate within a forked end plate 139 which, in turn can pivot relative to frame 100 about its pivot axis 142. The forked end plate is fixed its opposite end to an end of tucker bar 16.

Figure 5:
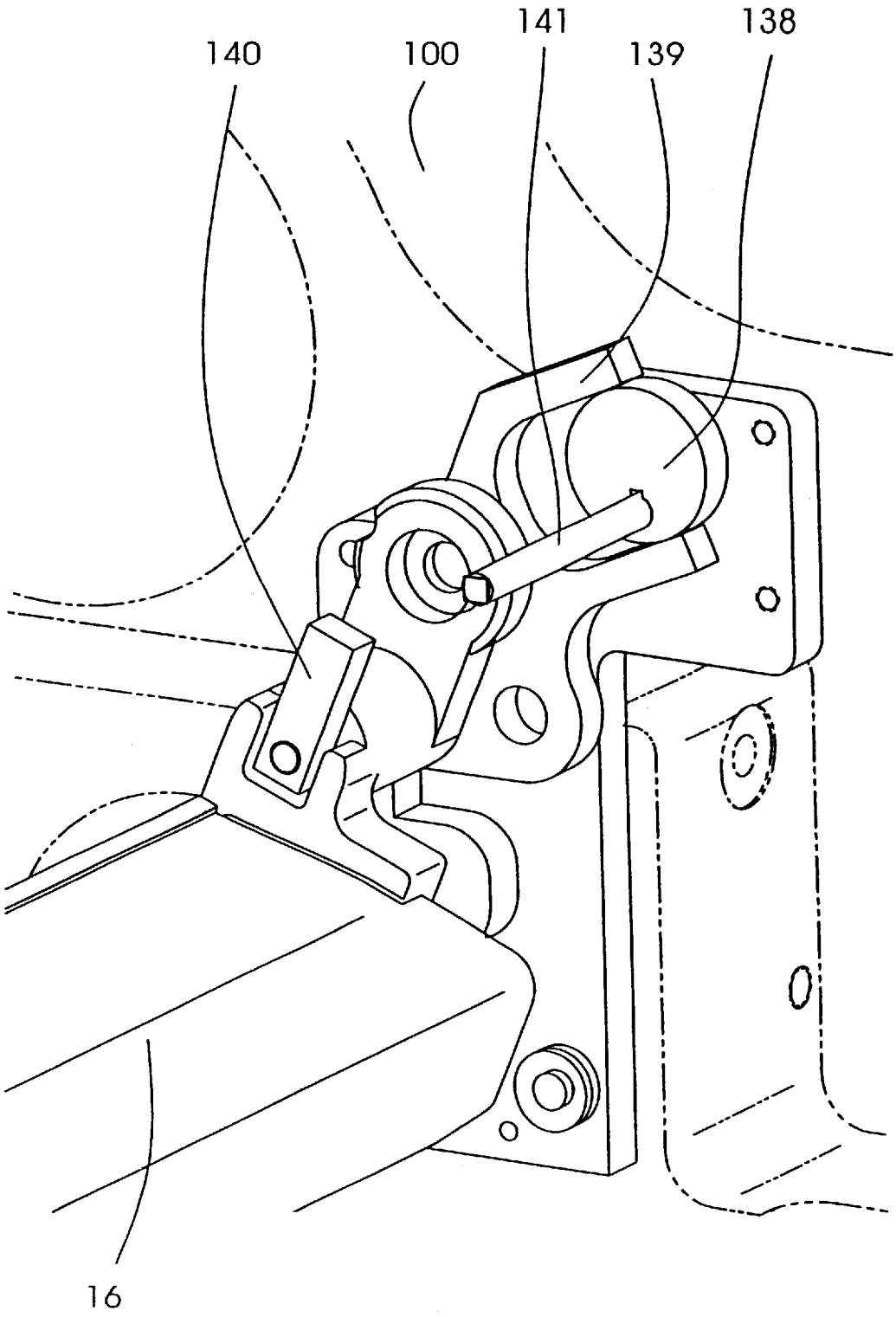
FIG. 5 shows a schematic view of the exemplary tucker bar control device shown in FIG. 4 with the tucker bar shown in a non-operating position.

As shown in FIG. 5, when the eccentric cam 138 rotates 180-degrees, the forked end of forked end plate 139 is moved in an upward position. The forked end plate 139 pivots about axis 142, thus moving the tucker bar 16 away from the plate cylinder to allow for plate installation and removal. Lever 140, located on the tucker bar 16 can be used to manually move the tucker bar away from the plate cylinder for cleaning and maintenance.

What is claimed is:

1. A printing unit comprising:

a plate cylinder having an axially-extending gap;

a tucker bar having an operating position, the tucker bar in the operating position capable of tucking a tail end of a printing plate into the axially-extending gap;

a tucker bar control device for automatically moving the tucker bar away from the operating position to a non-operating position;

a first blanket cylinder adjacent to the plate cylinder and a second blanket cylinder adjacent the first blanket cylinder and wherein the tucker bar in the non-operating position is located at a nip between the first and second blanket cylinders.

2. The printing unit as recited in claim 1 further comprising a frame supporting the plate cylinder and the tucker bar, the tucker bar control device being attached to the frame.

3. The printing unit as recited in claim 1 if wherein the tucker bar control device includes an eccentric cam.

4. The printing unit as recited in claim 1 wherein the tucker bar control device includes a pneumatic motor for rotating the eccentric cam.

5. The printing unit as recited in claim 1 further comprising a lever operationally connected to the tucker bar and the tucker bar control device for manually moving the tucker bar from the operating position to the non-operating position.

6. A method for plating a plate cylinder comprising the steps of:

using a tucker bar control device to automatically move a tucker bar from an operating position to a non-operating position so as to permit access to an axially-extending gap in the plate cylinder; and inserting a lead end of a printing plate into the axially extending gap while the tucker bar is in the non-operating position;

the tucker bar in the operating position guarding a nip between the plate cylinder and an adjacent blanket cylinder; and the tucker bar in the non-operating position guarding a nip between the adjacent blanket cylinder and a second blanket cylinder.

7. The method as recited in claim 6 wherein the tucker bar guards the nip between the plate cylinder and the adjacent blanket cylinder in the operating position during a printing operation and during a plate loading operation when the plate cylinder is moving in a forward direction, and guards the nip between the adjacent blanket cylinder and the second blanket cylinder in the non-operating position during a plate ejecting operation when the plate cylinder is moving in a reverse direction.

* * * * *